US009101007B2

(12) United States Patent
Chan et al.

(10) Patent No.: US 9,101,007 B2
(45) Date of Patent: Aug. 4, 2015

(54) DISPLAY PANEL AND METHOD OF FABRICATING THE SAME

(71) Applicant: AU Optronics Corp., Hsin-Chu (TW)

(72) Inventors: Chi-Shun Chan, Hsin-Chu (TW); Shih-Hsing Hung, Hsin-Chu (TW); Chih-Jen Yang, Hsin-Chu (TW); Fong-Yu Huang, Hsin-Chu (TW); Meng-Ting Lee, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 0 days.

(21) Appl. No.: 14/337,250

(22) Filed: Jul. 22, 2014

(65) Prior Publication Data

US 2015/0163866 A1 Jun. 11, 2015

(30) Foreign Application Priority Data

Dec. 10, 2013 (TW) ..... 102145457 A

(51) Int. Cl.

| | |
|---|---|
| ***H05B 33/04*** | (2006.01) |
| ***H05B 33/14*** | (2006.01) |
| ***H05B 33/22*** | (2006.01) |
| ***H05B 33/10*** | (2006.01) |

(52) U.S. Cl.

CPC ..... *H05B 33/04* (2013.01); *H05B 33/10* (2013.01); *H05B 33/145* (2013.01); *H05B 33/22* (2013.01)

(58) Field of Classification Search

CPC ..... H05B 33/04; H05B 33/22; H05B 33/10; H05B 33/145

USPC ..... 313/512

See application file for complete search history.

(56) References Cited

U.S. PATENT DOCUMENTS

| | | | | |
|---|---|---|---|---|
| 6,849,877 | B2 | 2/2005 | Yamazaki | |
| 7,229,900 | B2 | 6/2007 | Takayama | |
| 7,741,769 | B2 * | 6/2010 | Hayashi | 313/498 |
| 2004/0197944 | A1 | 10/2004 | Chen | |
| 2005/0067953 | A1 * | 3/2005 | Yamazaki et al. | 313/506 |
| 2007/0164673 | A1 | 7/2007 | Hu | |
| 2007/0241674 | A1 | 10/2007 | Chao | |
| 2008/0143906 | A1 * | 6/2008 | Allemand et al. | 349/43 |
| 2010/0244682 | A1 * | 9/2010 | Lee et al. | 313/512 |
| 2012/0262058 | A1 * | 10/2012 | Park | 313/512 |
| 2014/0252944 | A1 * | 9/2014 | Lee et al. | 313/504 |

FOREIGN PATENT DOCUMENTS

| | | |
|---|---|---|
| TW | 570472 | 1/2004 |
| TW | I221678 | 10/2004 |
| TW | I335041 | 12/2010 |
| TW | 201342329 | 10/2013 |

* cited by examiner

*Primary Examiner* — Donald Raleigh

(74) *Attorney, Agent, or Firm* — Winston Hsu; Scott Margo

(57) ABSTRACT

A display panel includes a substrate, a luminous display array, a thin film encapsulation, an auxiliary layer, an optical film and an optical clear adhesive. The luminous display array is disposed on the substrate. The thin film encapsulation layer is disposed on the substrate, covering the luminous display array. The auxiliary layer is disposed on the then thin film encapsulation. The auxiliary layer has an even top surface, and a shore hardness ranging from D4 to D60. The optical film is disposed on the auxiliary layer. The optical clear adhesive is disposed on the even top surface of the auxiliary layer for attaching the auxiliary layer and the optical film.

20 Claims, 5 Drawing Sheets

| | Sample 1 | Sample 2 | Sample 3 | Sample 4 | Sample 5 | Sample 6 |
|---|---|---|---|---|---|---|
| Elastic Modulus (MPa) | – | 4400 | 1800 | 1280 | 582 | 171 |
| Shore Hardness | – | D83 | D69 | D69 | A74 | A83 |
| Magnified diagram observed in microscope after Ca test |  |  |  |  |  |  |

DISPLAY PANEL AND METHOD OF FABRICATING THE SAME

BACKGROUND OF THE DISCLOSURE

1. Technical Field

The present disclosure relates to a display panel and method of fabricating the same, and more particularly, to a display panel having an auxiliary having a Shore hardness ranging from D4 to D60 to protect a luminous display array and method of fabricating the same.

2. Description of the Related Art

Organic light emitting diode (OLED) display panel is extremely sensitive to water, and thus water needs to be isolated during fabrication such that OLED devices are not damaged. In a conventional OLED display panel, a thin film encapsulation is formed on the OLED devices to block permeation of water (moisture) and oxygen. However, it is inevitably to have a certain number of particles during the fabrication process of thin film encapsulation; these particles will damage the thin film encapsulation in an optical thin film attachment process to be performed, and will deteriorate the water and oxygen barrier effect. The insufficient water and oxygen barrier effect seriously affects the reliability and lifetime of OLED display panel, and hinders the development of OLED display panel.

SUMMARY OF THE DISCLOSURE

It is therefore one of the objectives of the present disclosure to provide a display panel having high water-resistant effect and method of making the same.

According to one embodiment of the present disclosure, a display panel is provided. The display panel includes a substrate, a luminous display array, a thin film encapsulation, an auxiliary layer, an optical film and an optical clear adhesive. The luminous display array is disposed on the substrate. The thin film encapsulation is disposed on the substrate and covers the luminous display array. The auxiliary layer is disposed on the thin film encapsulation, wherein the auxiliary layer has an even top surface and a Shore hardness substantially ranging from D4 to D60. The optical film is disposed on the auxiliary layer. The optical clear adhesive is disposed between the even top surface of the auxiliary and the optical film and configured to attach the auxiliary layer and the optical film.

According to another embodiment of the present disclosure, a method of fabricating display panel is provided. The method includes the following steps. A substrate is provided. A luminous display array is formed on the substrate. A thin film encapsulation is formed on the substrate, wherein the thin film encapsulation covers the luminous display array. A liquid material layer is formed on the substrate and the thin film encapsulation, and a drying process is performed on the liquid material layer to form an auxiliary layer, wherein the auxiliary layer has an even top surface and a Shore hardness substantially ranging from D4 to D60. An optical film is provided and an optical clear adhesive is formed on a surface of the optical film. An attachment process is performed to attach the optical film to the even top surface of the auxiliary layer with the optical clear adhesive.

These and other objectives of the present disclosure will no doubt become obvious to those of ordinary skill in the art after reading the following detailed description of the preferred embodiment that is illustrated in the various figures and drawings.

DETAILED DESCRIPTION

To provide a better understanding of the present disclosure, preferred embodiments will be made in detail. The preferred embodiments of the present disclosure are illustrated in the accompanying drawings with numbered elements.

Figure 1:
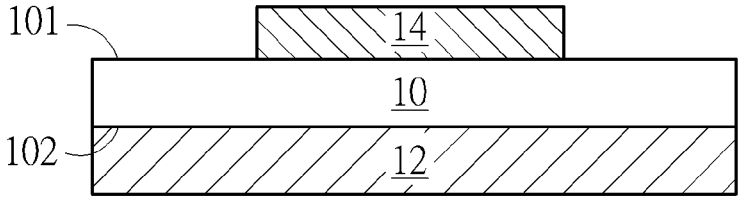
FIGS. 1-5 are schematic diagrams illustrating a method of fabricating display panel according to a preferred embodiment of the present disclosure.

Refer to FIGS. 1-5. FIGS. 1-5 are schematic diagrams illustrating a method of fabricating display panel according to a preferred embodiment of the present disclosure. In this embodiment, a method of fabricating an electroluminescent display panel e.g. an organic light emitting diode (OLED) display panel is exemplarily selected to illustrate the method of fabricating display panel, but not limited thereto. The method of fabricating display panel of the present disclosure may be used to fabricate other types of electroluminescent display panels e.g. polymer light emitting diode (PLED) display panel or inorganic light emitting diode display panel, and other types of display panels e.g. a quantum dot light emitting display panel. As shown in FIG. 1, a substrate 10 is provided. The substrate 10 has a first surface (e.g. front surface, or namely top surface, or namely inner surface) 101 and a second surface (e.g. back surface, or namely bottom surface, or namely outer surface) 102. The substrate 10 may be a flexible substrate e.g. a plastic substrate or any other substrates with flexible and bendable characteristics, or a rigid substrate e.g. a glass substrate, a quartz substrate, a semiconductor substrate or any other suitable rigid substrates. The substrate 10 may be a transparent substrate or a non-transparent (opaque) substrate. Then, at least one barrier layer 12 is optionally formed on the second surface 102 of the substrate 10. The barrier layer 12 is configured to provide the second surface 102 of the substrate 10 with a barrier effect, which can block permeation of water from the second surface 102 of the substrate 10. The material of the barrier layer 12 may include inorganic material, organic material or organic/inorganic hybrid material. In this embodiment, an active matrix organic light emitting diode (AMOLED) display panel is exemplarily illustrated, and thus a driving array 14 is formed on the first surface 101 of the substrate 10. The driving array 14 includes a plurality of driving devices e.g. thin film transistor (TFT) devices, capacitor devices and conductive lines e.g. gate lines, data lines and power lines. In an alternative embodiment, the display panel may be a passive matrix organic light emitting diode (PMOLED) display panel, and the driving array 14 may include a plurality of capacitor devices and conductive lines. The driving devices and conductive lines of the driving array 14 may be modified based on different configurations of display panel. The details of the driving array 14 are well known, and thus are not redundantly described.

Figure 2:
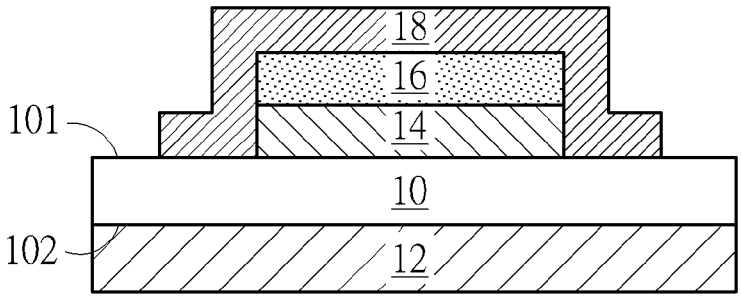

As shown in FIG. 2, a luminous display array 16 is then formed on the substrate 10. In this embodiment, the luminous display array 16 is formed on the driving array 14. The luminous display array 16 may include an electroluminescent display array, for example an OLED array, which includes a plurality of electroluminescent devices arranged in an array. The driving array 14 is disposed under the luminous display array 16, and the driving array 14 is electrically connected to the luminous display array 16 for driving the luminous display array 16. In addition, there may not be any substrate or material layer existing between the luminous display array 16 and the driving array 14. Subsequently, a thin film encapsulation 18 is formed on the first surface 101 of the substrate 10, where the thin film encapsulation 18 covers the luminous display array 16. Specifically, the thin film encapsulation 18 at least covers the top surface of the luminous display array 16, and may further covers the sidewall of the luminous display array 16 and/or the sidewall of the driving array 14. For example, the inner surface (or namely bottom surface) of the thin film encapsulation 18 covers and is contacted with the top surface and the lateral sidewall of the luminous display array 16, the lateral sidewall of the driving array 14, and part of the first surface 101 of the substrate 10. The thin film encapsulation 18 may be a single-layered thin film encapsulation or a multi-layered thin film encapsulation comprising a plurality of encapsulating thin films, and the thickness of each encapsulating thin film is substantially less than 1 micrometer. In addition, when the thin film encapsulation 18 is a single-layered thin film encapsulation, the material of the thin film encapsulation 18 may include inorganic material, organic material or organic/inorganic hybrid material; when the thin film encapsulation 18 is a multi-layered thin film encapsulation, the material of each encapsulating thin film may individually include inorganic material, organic material or organic/inorganic hybrid material. The organic material of the thin film encapsulation 18 may include polyethylene terephthalate (PET), poly ethylene naphthalate (PEN), poly (methyl methacrylate) (PMMA), polyimide (PI), etc.; and the inorganic material of the thin film encapsulation 18 may include silicon oxide, silicon nitride, silicon oxynitride, aluminum oxide, etc., but not limited thereto.

Figure 3:
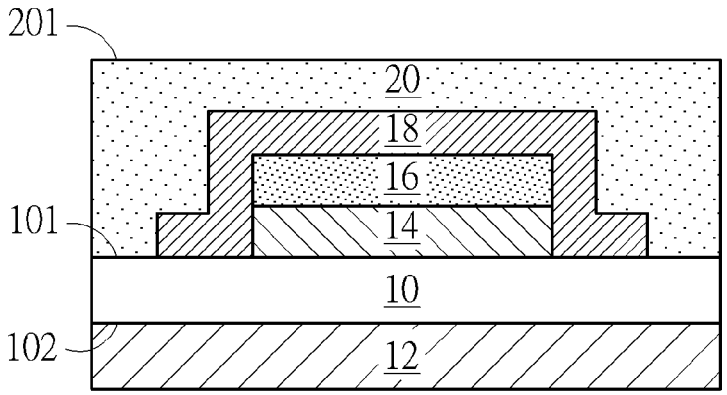

As shown in FIG. 3, a liquid material layer is formed on the substrate 10 and the thin film encapsulation 18, and a drying process is performed on the liquid material layer to form an auxiliary layer 20, where the auxiliary layer 20 has an even top surface 201. For example, the bottom surface of the auxiliary layer 20 covers and is contacted with the top surface and lateral sidewall of the thin film encapsulation 18 and another part of first surface 101 of the substrate 10. In this embodiment, the thickness of the auxiliary layer 20 is greater than 1 micrometer, for example, the thickness of the auxiliary layer 20 is substantially between 2 micrometers and 50 micrometers, and preferably substantially between 2 micrometers and 30 micrometers, but not limited thereto. In addition, the Shore hardness of the auxiliary layer 20 is substantially between D4 and D60, and the elastic modulus (also known to as Modulus of Elasticity or Young's Modulus) of the auxiliary layer 20 is substantially between 10 megapascals (MPa) and 3000 MPa, but not limited thereto. In this embodiment, the auxiliary layer 20 and the thin film encapsulation 18 have diverse characteristics. For instance, the auxiliary layer 20 is form by a liquidic process (or namely liquid process), but not a non-liquidic process such as a deposition process or an attachment process. In addition, the thickness of the auxiliary layer 20 is greater than the thickness of the thin film encapsulation 18, and the Shore hardness and the elastic modulus of the auxiliary layer 20 lie in the aforementioned range. Consequently, the auxiliary layer 20 is able to provide buffer and protection effects, and prevent the thin film encapsulation 18 from being damaged in successive optical film attachment process. As a result, the water-resistant effect of the thin film encapsulation 18 can be maintained. In this embodiment, the auxiliary layer 20 may include a sealing material formed in a liquidic manner, and cured in a curing manner. For example, the sealing material may include a thermal-curable sealing material, a photo-curable sealing material, a non-UV-curable and non-thermal-curable sealing material or a hybrid sealing material. The auxiliary layer 20 of this embodiment is not a sealing material that is formed by a non-liquidic process. For example, the auxiliary layer 20 is not an optical clear adhesive (OCA) or a pressure sensitive adhesive (PSA). The material of the auxiliary layer 20 preferably includes organic material such as epoxy resin or acrylic resin, but not limited thereto. In this embodiment, the thin film encapsulation 18 has a first refractive index, the auxiliary layer 20 has a second refractive index, and the second refractive index is greater than or substantially equal to the first refractive index in order to increase light extraction efficiency. For example, the first refractive index and the second refractive index may be both substantially between 1.3 and 3, and the second refractive index is preferably, but not limited to be, greater than the first refractive index when choosing the materials of the thin film encapsulation 18 and the auxiliary layer 20. Accordingly, the light extraction efficiency can be improved.

Figure 4:
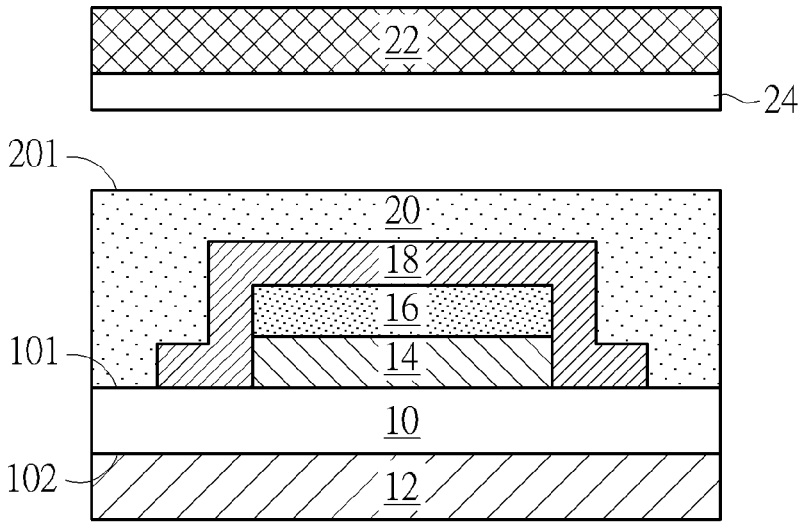

As shown in FIG. 4, an optical film 22 is provided, and an optical clear adhesive 24 is formed on the surface of the optical film 22. The optical film 22 may include a polarizing sheet to increase contrast ratio, but not limited thereto. The optical film 22 may also be any film that can provide desired optical effect. For example, the optical film 22 may be an anti-reflection film, an anti-glare film, a phase compensation film or other optical films with desired effects.

Figure 5:
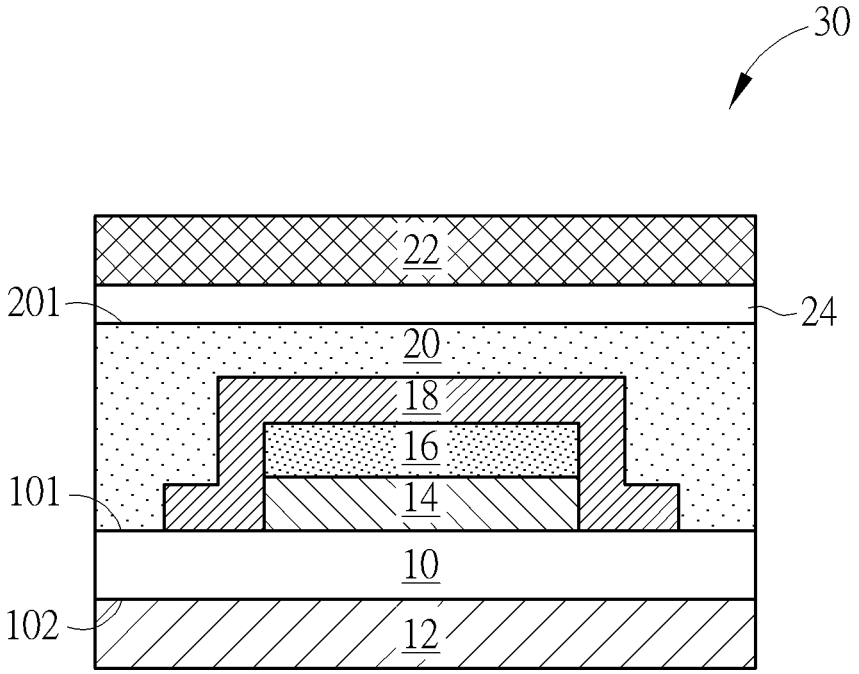

As shown in FIG. 5, an attachment process is provided to attach the optical film 22 to the even top surface 201 of the auxiliary layer 20 with the optical clear adhesive 24 to form a display panel 30 of this embodiment. For example, the top surface of the optical clear adhesive 24 is contacted with the bottom surface of the optical film 22, and the bottom surface of the optical clear adhesive 24 is contacted with the even top surface 201 of the auxiliary layer 20. As previously described, since the thickness of the auxiliary layer 20 is substantially between 2 micrometers and 50 micrometers, the Shore hardness of the auxiliary layer 20 is substantially between D4 and D60 and the elastic modulus of the auxiliary layer 20 is substantially between 10 MPa and 3000 MPa, the auxiliary layer 20 is able to provide good buffer and protection effects, and prevent the thin film encapsulation 18 from being damaged in the optical film attachment process. As a result, the water-resistant effect of the thin film encapsulation 18 can be maintained, which can increase the reliability and lifetime of the display panel 30.

Figure 6:
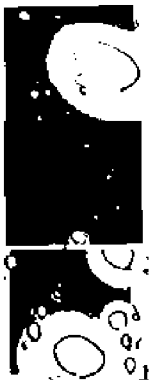
FIG. 6 is an experimental result showing the water vapor transmission rate of the auxiliary layer of the present disclosure.
Figure 6:
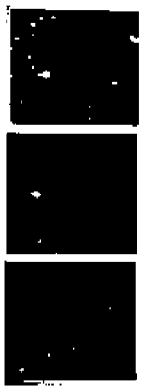
Figure 6:
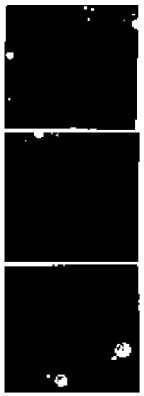
Figure 6:
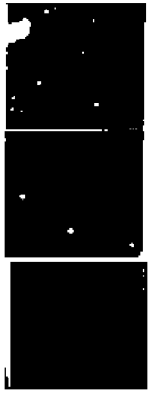
Figure 6:
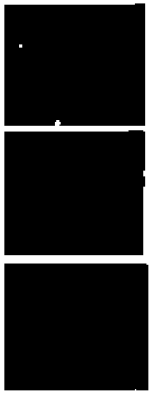
Figure 6:
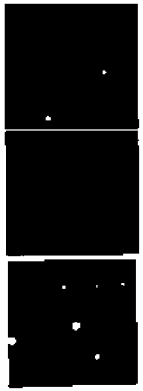

Refer to FIG. 6. FIG. 6 is an experimental result showing the water vapor transmission rate of the auxiliary layer of the present disclosure. In this embodiment, the water vapor transmission rate (WVTR) is obtained by calcium test (Ca test), which is well known. Ca test obtains the water vapor transmission rate based on corrosion of active metal film. In Ca test, a calcium film is formed, for example by evaporation, on a test substrate, and the sample to be tested is formed on the calcium film and then placed in a high temperature and humidity storage. Calcium is apt to react with water and oxygen, and the transparency rate of the reacted calcium film will increase. Therefore, the water vapor transmission rate can be quantified by monitoring the change of transparency rate of the calcium film. In this embodiment, Ca test is performed in an environment where the temperature is about 60° C. and the relative humidity is about 90%. In FIG. 6, Sample 1 is a control sample, in which the calcium film is formed under a conventional thin film encapsulation (i.e. the structure includes a calcium film and a thin film encapsulation covering the calcium, and no auxiliary layer covers the thin film encapsulation); Samples 2-6 are experimental samples, in which the calcium film is formed under the auxiliary (i.e. the structure includes a calcium film, a thin film encapsulation covering the calcium, and an auxiliary layer covering the thin film encapsulation), and the auxiliary layers in samples 2-6 have different Shore hardness and elastic modulus. As shown in the magnified diagrams observed through a microscope of FIG. 6, the numbers and areas of white zones in Samples 2-6 is significantly less than that of Sample 1. The experimental result evidently shows that Samples 2-6 have lower water vapor transmission rate because the thin film encapsulation is well protected by the auxiliary layer, and thus the wafer-resistant effect of the thin film encapsulation is maintained. The Shore hardness and the elastic modulus of the auxiliary layer in Samples 2-6 are listed as follows. Sample 2: Shore hardness: D83, elastic modulus: 4400 MPa; Sample 3: Shore hardness: D69, elastic modulus: 1800 MPa; Sample 4: Shore hardness: D69, elastic modulus: 1280 MPa; Sample 5: Shore hardness: A74, elastic modulus: 582 MPa; and Sample 6: Shore hardness: A83, elastic modulus: 171 MPa. In addition, the numbers and areas of white zones in Samples 5-6 is less than that of Samples 2-4, which indicates that the protection ability of the auxiliary layer is relevant to its Shore hardness and elastic modulus. Table 1 is a conversion table of Shore A hardness and Shore D hardness. As shown in Table 1, Shore hardness A74 is approximately between Shore hardness D20-D25, and Shore hardness A83 is approximately between Shore hardness D30-D35. That is to say, the Shore hardness of Samples 5-6 both lies between D4-D60. In addition, the elastic modulus of Samples 5-6 is within 10 MPa and 3000 MPa. Therefore, it is evidently proved that the auxiliary layer has good protection effect on the thin film encapsulation when the Shore hardness is between D4 and D60 and when the elastic modulus is between 10 MPa and 3000 MPa, and the intact thin film encapsulation can therefore provide water barrier effect. Regarding Sample 2, the Shore hardness is D83 and the elastic modulus is 4000 MPa, i.e. the Shore hardness is beyond the range of D4 and D60 and the elastic modulus is beyond the range of 10 MPa and 3000 MPa. Thus, compared to Samples 5-6, the protection ability of Sample 2 is not sufficient. Regarding Sample 3, the Shore hardness is D69 and the elastic modulus is 1800 MPa, i.e. the elastic modulus is within the range of 10 MPa and 3000 MPa, but the Shore hardness is beyond the range of D4 and D60. Thus, compared to Samples 5-6, the protection ability of Sample 3 is not sufficient. Regarding Sample 4, the Shore hardness is D69 and the elastic modulus is 1280 MPa, i.e. the elastic modulus is within the range of 10 MPa and 3000 MPa, but the Shore hardness is beyond the range of D4 and D60. Thus, compared to Samples 5-6, the protection ability of Sample 4 is not sufficient.

TABLE 1

| Shore D Hardness | Shore A Hardness |
|---|---|
| 90 | |
| 86 | |
| 83 | |
| 80 | |
| 77 | |
| 74 | |
| 70 | |
| 65 | |
| 60 | 98 |
| 55 | 96 |
| 50 | 94 |
| 42 | 90 |
| 38 | 86 |

TABLE 1-continued

| Shore D Hardness | Shore A Hardness |
|---|---|
| 35 | 85 |
| 30 | 80 |
| 25 | 75 |
| 20 | 70 |
| 15 | 60 |
| 12 | 50 |
| 10 | 40 |
| 8 | 30 |
| 6.5 | 20 |
| 4 | 10 |

Figure 7:
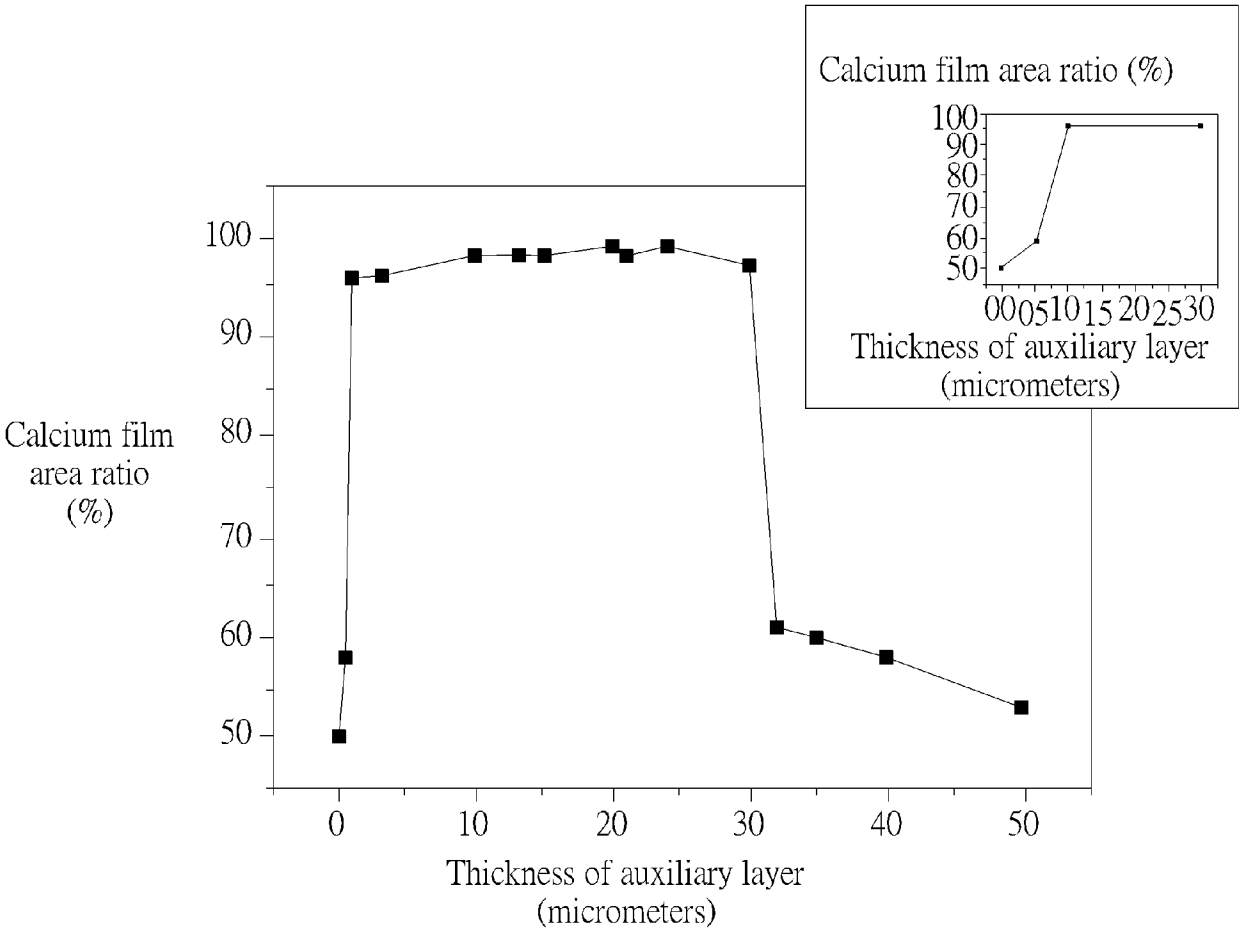
FIG. 7 illustrates the relation between the calcium film area ratio and the thickness of auxiliary layer after Ca test.

Refer to FIG. 7. FIG. 7 illustrates the relation between the calcium film area ratio and the thickness of auxiliary layer after Ca test. In this embodiment, Ca test is performed in an environment where the temperature is about 60° C. and the relative humidity is about 90%, and the calcium film area ratio is the ratio of the area of the calcium film not reacting with water and/or oxygen after Ca test to the overall area of the calcium film before Ca test. As shown in FIG. 7, when the thickness of the auxiliary layer is substantially between 2 micrometers and 50 micrometers, the calcium film area ratio is significantly higher; when the thickness of the auxiliary layer is beyond substantially 2 micrometers and 50 micrometers, the calcium film area ratio is significantly lower. This evidence shows that the auxiliary layer has better protection effect on the thin film encapsulation when its thickness is substantially between 2 micrometers and 50 micrometers, particularly substantially between 2 micrometers and 30 micrometers.

In conclusion, the auxiliary layer of the display panel of the present disclosure has been proven to be able to provide buffer and protection effect on the thin film encapsulation, which prevents the thin film encapsulation from being damaged by particles generated in an attachment process. Consequently, the water vapor transmission rate is effectively reduced, and the reliability and lifetime of display panel is therefore increased.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display panel, comprising:

a substrate;

a luminous display array, disposed on the substrate;

a thin film encapsulation, disposed on the substrate and covering the luminous display array;

an auxiliary layer, disposed on the thin film encapsulation, wherein the auxiliary layer has an even top surface and a Shore hardness substantially ranging from D4 to D60;

an optical film, disposed on the auxiliary layer; and an optical clear adhesive, disposed between the even top surface of the auxiliary and the optical film, configured to attach the auxiliary layer and the optical film.

2. The display panel of claim 1, wherein an elastic modulus of the auxiliary layer is substantially between 10 megapascals (MPa) and 3000 MPa.

3. The display panel of claim 1, wherein a thickness of the auxiliary layer is substantially between 2 micrometers and 50 micrometers.

4. The display panel of claim 1, wherein the auxiliary layer comprises a sealing material.

5. The display panel of claim 4, wherein the sealing material comprises a thermal-curable sealing material, a photo-curable sealing material, a non-UV-curable and non-thermal-curable sealing material or a hybrid sealing material.

6. The display panel of claim 1, wherein the thin film encapsulation comprises a plurality of encapsulating thin films, and a thickness of each of the encapsulating thin films is substantially less than 1 micrometer.

7. The display panel of claim 1, wherein the thin film encapsulation has a first refractive index, the auxiliary layer has a second refractive index, and the second refractive index is greater than or substantially equal to the first refractive index.

8. The display panel of claim 7, wherein the second refractive index is substantially between 1.3 and 3.

9. The display panel of claim 1, wherein the substrate comprises a flexible substrate.

10. The display panel of claim 1, wherein the optical film comprises a polarizing sheet.

11. The display panel of claim 1, wherein the luminous display array comprises an electroluminescent display array.

12. The display panel of claim 1, further comprising a driving array, disposed on the substrate and under the luminous display array.

13. A method of fabricating display panel, comprising:

providing a substrate;

forming a luminous display array on the substrate;

forming a thin film encapsulation on the substrate, wherein the thin film encapsulation covers the luminous display array;

forming a liquid material layer on the substrate and the thin film encapsulation, and performing a drying process on the liquid material layer to form an auxiliary layer, wherein the auxiliary layer has an even top surface and a Shore hardness substantially ranging from D4 to D60;

providing an optical film and forming an optical clear adhesive on a surface of the optical film; and performing an attachment process to attach the optical film to the even top surface of the auxiliary layer with the optical clear adhesive.

14. The method of fabricating display panel of claim 13, wherein an elastic modulus of the auxiliary layer is substantially between 10 megapascals (MPa) and 3000 MPa.

15. The method of fabricating display panel of claim 13, wherein a thickness of the auxiliary layer is substantially between 2 micrometers and 50 micrometers.

16. The method of fabricating display panel of claim 13, wherein the auxiliary layer comprises a sealing material, and the sealing material comprises a thermal-curable sealing material, a photo-curable sealing material, a non-UV-curable and non-thermal-curable sealing material or a hybrid sealing material.

17. The method of fabricating display panel of claim 13, wherein the thin film encapsulation comprises a plurality of encapsulating thin films, and a thickness of each of the encapsulating thin films is substantially less than 1 micrometer.

18. The method of fabricating display panel of claim 13, wherein the thin film encapsulation has a first refractive index, the auxiliary layer has a second refractive index, and the second refractive index is greater than or substantially equal to the first refractive index.

19. The method of fabricating display panel of claim 18, wherein the second refractive index is substantially between 1.3 and 3.

20. The method of fabricating display panel of claim 13, further comprising forming a driving array on the substrate prior to forming the luminous display array.

* * * * *